US005259615A

United States Patent [19]

Lindström

[11] Patent Number: 5,259,615

[45] Date of Patent: Nov. 9, 1993

[54] PAYOUT GATE FOR A GAMING DEVICE

[75] Inventor: Matti Lindström, Espoo, Finland

[73] Assignee: Raha-automaattiyhdistys, Espoo, Finland

[21] Appl. No.: 854,610

[22] PCT Filed: Jan. 2, 1991

[86] PCT No.: PCT/FI91/00002

§ 371 Date: Jun. 10, 1992

§ 102(e) Date: Jun. 10, 1992

[87] PCT Pub. No.: WO91/10218

PCT Pub. Date: Jul. 11, 1991

[30] Foreign Application Priority Data

Jan. 5, 1990 [FI] Finland ..... 900060

[51] Int. Cl.[5] ..... A63F 7/40; A63F 7/30

[52] U.S. Cl. ..... 273/121 B; 273/138 A

[58] Field of Search ..... 273/121 A, 121 B, 138 A, 273/143 R

[56] References Cited

U.S. PATENT DOCUMENTS 4,487,414 12/1984 Karkkainen et al. ..... 273/371
4,822,046 4/1989 Kim et al. ..... 273/127 R
5,120,060 6/1992 Parker et al. ..... 273/138 A

FOREIGN PATENT DOCUMENTS 37312 of 1968 Finland ..... 273/121 B

*Primary Examiner*—Benjamin H. Layno
*Attorney, Agent, or Firm*—Nixon & Vanderhye

[57] ABSTRACT

A payout gate for a gaming device, which comprises a gaming panel supporting several payout gates, each gate comprising two pins fastened to a bearer, which pins form between themselves for a coin moving along the gaming panel an inlet into a sensor operating a machinery for distributing payouts, and a tightening means fastening the bearer to the gaming panel, in order to fasten the pins to the gaming pane with a constant tightness, the tightening means comprises a tightening part to be fastened firmly in a constant position with respect to the gaming panel and a spring means situated between the tightening part and the bearer and pressing the bearer axially flexibly against the gaming panel.

8 Claims, 2 Drawing Sheets

FIG. 2
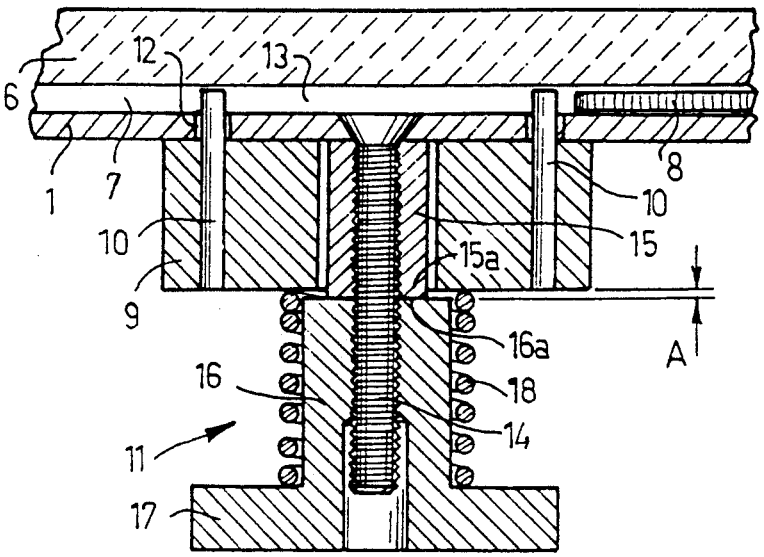
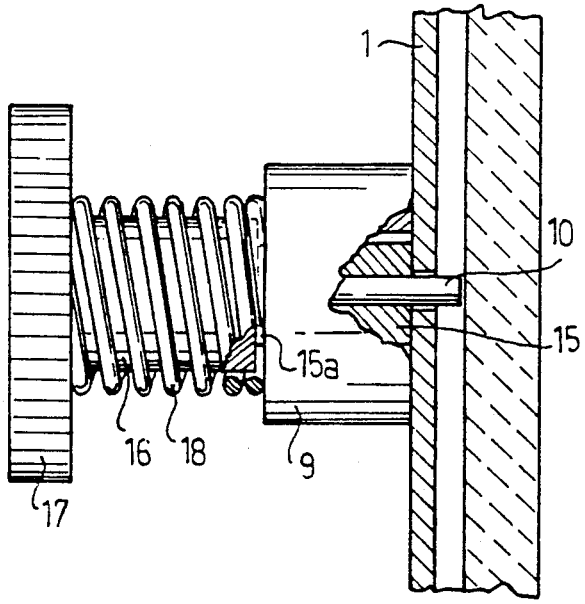
FIG. 3

PAYOUT GATE FOR A GAMING DEVICE

BACKGROUND OF THE INVENTION

The present invention relates to a payout gate for a gaming device provided with a gaming panel supporting several payout gates, each gate comprising two pins projecting from a level of the gaming panel, forming between themselves for a coin or a token moving along the gaming panel an inlet into a sensor operating a machinery for distributing payouts, a bearer for supporting the pins and a tightening means fastening the bearer to the gaming panel.

Various gaming devices are known, in which payout gates of the type mentioned are used in order to control the operation of the game, such as a machinery for distributing payouts, a mechanism for scoring points or another actuating mechanism, depending on whether a coin hit along the gaming panel passes through a payout gate or not. Therefore, a coin does not only mean metal coins, but also various tokens and similar, usually round plate-like metal pieces. However, the invention will be described in the following for the sake of clearness in connection with a gaming device in which a coin is hit along the gaming panel by means of a hitting device and depending on how the coin runs the player either looses the stake or wins. In the upper part of the panel there are payout gates, which lead to a sensor operating the machinery for distributing payouts. When the coin passes through a gate, the player wins a certain sum, and when the coin passes beside the gate, the player looses his stake.

The height and/or inclined position of the inlet formed by the pair of pins of a payout gate has a substantial influence on how difficult it is for the player to get a coin hit through the payout gate in the gaming panel. In order to change and adjust the payout proportion in a gaming device as well as in connection with the maintenance of the gaming device, it is necessary to detach the pins of the payout gate and to refasten them to the gaming panel in a new position.

Such an easily adjustable payout gate is described in Finnish Patent 37712. In the gate structure described, the pin bearer can be adjusted into various positions and locked by means of a wing nut to a screw projecting from the back surface of the gaming panel. By turning the wing nut the bearer is tightened with a suitable tightness against the gaming panel.

However, a drawback of such a known payout gate is that a tightening of the gate carried out manually usually remains very inaccurate. It has turned out that the tightness of the fastening of the gate has an influence on the resilience of the pins, which again has a substantial effect on the tendency of the gate to allow also other coins to pass through the gate than those coming accurately between the pins and thus has an effect also on the payout proportion of the gate. A gate causing a coin hitting a pin to rebound and preventing the coin from passing through the inlet between the pins can, tightened to another tightness, dampen the kinetic energy of a coin hitting the pin in the same manner and cause the coin to fall towards the inlet and further through it. To tighten the known payout gate to an appropriate tightness depends greatly on the experience of the person attending to the maintenance, because it is difficult to define the degree of tightness accurately by means of instructions. Therefore, differences exist between gaming devices, which differences are difficult to foresee or compensate. This is a remarkable problem, because the influence of the fastening tightness of the gate on the payout proportion is up to 20%.

SUMMARY OF THE INVENTION

The object of this invention is to provide a payout gate avoiding the drawback mentioned above and making it possible to tighten the gate to the same tightness each time when the positions of the pins are changed and in connection with the maintenance of the gate. This object is achieved by means of a payout gate according to the invention, characterized in that the tightening means comprises a tightening part arranged to be fastened firmly in a constant position with respect to the gaming panel, and a spring means situated between the tightening part and the bearer of the pins and pressing the bearer axially flexibly against the gaming panel.

The invention is based on the idea that the bearer of the pins is pressed by the spring means against the gaming panel by means of the tightening part to be fastened to the gaming panel. In this way the tightening part can always be tightened manually "to the bottom", so that a supporting surface is provided for the spring means, which supporting surface is always located in the same position with respect to the gaming panel, irrespective of whether the tightening part is tightened more tightly or more loosely against said supporting surface. Consequently, the tightness of the tightening part does not substantially influence the spring force directed by the spring means on the bearer. Because it is easy to manufacture spring means, e.g. helical springs, with a desired resilience and accurate dimensions, the gate can be fastened with a constant tightness and the gate pins provided with a constant resilience, respectively, which is necessary in order to secure that the payout proportion remains constant.

In the following, the invention is explained more closely referring to the drawing enclosed, in which

BRIEF DESCRIPTION OF THE DRAWINGS

FIGS. 2 and 3 show an enlarged axial section of a preferable embodiment of the payout gate along line II—II of FIG. 1 from above and from the side.

DETAILED DESCRIPTION OF THE PREFERRED EMBODIMENT

Figure 1:
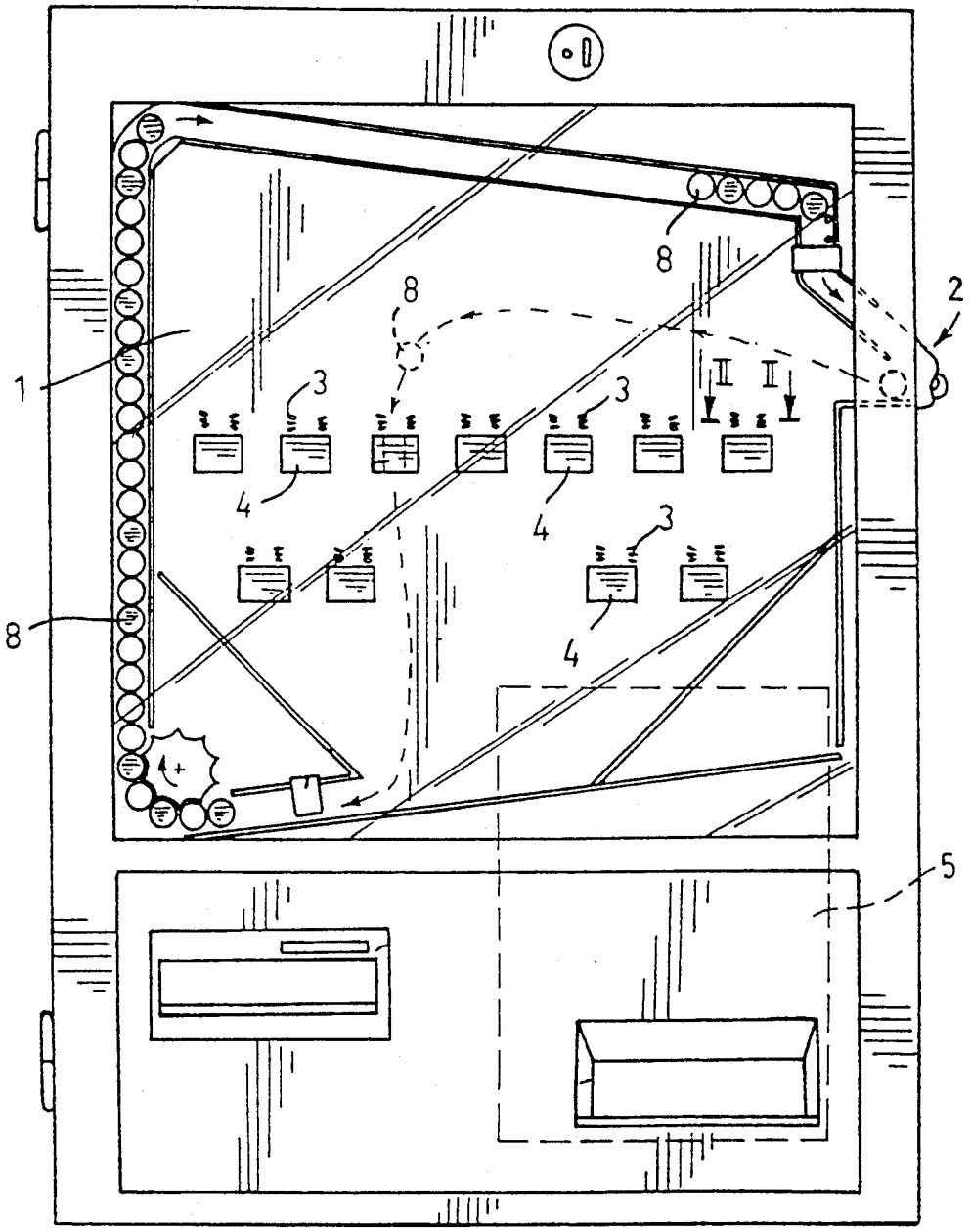
FIG. 1 is a front view of a known gaming device provided with payout gates according to the invention.

As to the construction and operation, the gaming device shown in FIG. 1 of the drawing corresponds to the gaming device described in Finnish Patent 63123. Therefore, only those parts of the gaming device are explained in this connection which relate to the present invention.

The gaming device comprises a vertical gaming panel 1 and a hitting device 2 at one side thereof. The gaming panel comprises several horizontal payout gates 3 at a distance from each other and below each gate there is a sensor 4 actuating a machinery 5 for distributing payouts in the gaming device. The gaming panel is covered by a glass sheet 6 in such a way that inbetween remains a space 7 for coins 8 to move along the gaming panel. A coin is hit along the gaming panel from the hitting device in such a way that the coin moves along the gaming panel and falls downwards at the same time, as shown with broken lines. The coin then either passes through one of the payout gates or passes besides them.

The payout gate 3 is mainly mounted behind the gaming panel. The gate comprises a bearer 9 for two parallel pins 10 projecting therefrom and a tightening means 11, by which the bearer is fastened to the gaming panel. The gaming panel comprises three holes 12 for each pin and the pins can be pushed alternatively through one pair of holes to extend into the space 7 at a short distance from the glass sheet when the bearer is pressed against the back surface of the gaming panel. The pins form between themselves an inlet 13 dimensioned to allow a coin to pass through.

The tightening means 11 of the gate comprises a socket-like base part 15 stationarily fastened to the gaming panel by a screw 14 and extending through a central hole of the bearer, and a knob-like tightening part 16 turned detachably on said screw and being provided with a flange 17. Between the tightening part and the bearer there is a helical compression spring 18.

The base part comprises an abutment 15*a*, against which the tightening part is pressed with its end face 16*a*, the tightening part being turned on the screw to the bottom, i.e. against the abutment 15*a*. The bearer 9 is dimensioned in such a way that between the tightening part and the bearer remains a flexing space A, when the spring presses the bearer against the gaming panel. The length and the resilience of the spring are manufactured in such a way that the pins 10 will have the desired flexibility when the spring presses the bearer against the gaming panel.

It is noticed that the tightness by which the tightening part 16 is tightened against the base part 15, when the tightening part is turned into contact with the abutment 15*a*, does not substantially influence the axial position of the flange 17. Therefore, the spring presses the bearer against the gaming panel always with the same spring force, when the tightening part is turned to the bottom. The flexing space A is needed in order that the gate would stand vibrations caused by hard use. The flexing space must not be so big as to enable the pin to yield into the gaming panel so much that a coin could pass between the glass sheet and the pin end. The pin end must not extend into contact with the glass sheet either.

The drawing and the description relating thereto are only meant to visualize the idea of the invention. As to the details, the construction of the invention can vary within the scope of the claims. Thus, it is possible that the socket-like base part 15 is formed directly in one piece with the gaming panel or that the tightening part 16 extends as far as to the back surface of the gaming panel, the actual gaming panel functioning as the base part. Instead of a helical spring, also flexible means of other kinds can be used, which can be manufactured with a constant resilience.

I claim:

1. A payout gate for a gaming device comprising a gaming panel supporting several payout gates, each gate comprising a two pins (10) projecting from a level of the gaming panel, forming between themselves for a coin or a token moving along the gaming panel an inlet into a sensor operating a machinery for distributing payouts, a bearer for supporting the pins a tightening means fastening the bearer to the gaming panel, said tightening means comprising a tightening part arranged to be fastened firmly in a constant position with respect to the gaming panel and a spring means situated between the tightening part and the bearer of the pins and pressing the bearer axially flexibly against the gaming panel.

2. A payout gate according to claim 1, wherein a base part is stationarily fastened to the gaming panel and the tightening part is arranged to be detachably fastened against the base part in order to press the spring means against the bearer of the pins.

3. A payout gate according to claim 2, wherein a screw is projecting from the base part and the base part comprises an abutment, against which the tightening part is turned on the screw axially stationary.

4. A payout gate according to claim 2, wherein, between the tightening part and the bearer, a flexing space is provided allowing the bearer to move axially flexibly with respect to the tightening part under the influence of the spring means.

5. A payout gate according to claim 4, in which a glass sheet is positioned in front of the gaming panel substantially at a distance from the gaming panel corresponding to the coin thickness, said flexing space and the distance of the pin end from the glass sheet (6) in the operating position of the pins are together smaller than the thickness of the coin.

6. A payout gate according to claim 2, wherein the spring means is a helical spring.

7. A payout gate according to claim 6, wherein the base part is socket-like and fastened to the gaming panel by means of a screw, that the tightening part is formed by a flanged threaded knob, the flange of which forms a stop for the helical spring surrounding the knob and the opposite end forms an end face, by which the knob is pressed against an abutment of the base part and which restricts the axial flexible movement of the bearer and that the base part extends through the bearer.

8. A payout gate according to claim 2, the base part is formed by the gaming panel.

* * * * *